US007487555B2

(12) United States Patent
Takeda et al.

(10) Patent No.: US 7,487,555 B2
(45) Date of Patent: Feb. 10, 2009

(54) SOCKS

(75) Inventors: Daisuke Takeda, Fujimi (JP); Kimio Ishikawa, Kira-machi (JP)

(73) Assignee: Takeda Leg Wear Co., Ltd., Saitama (JP)

( * ) Notice: Subject to any disclaimer, the term of this patent is extended or adjusted under 35 U.S.C. 154(b) by 0 days.

(21) Appl. No.: 10/519,852

(22) PCT Filed: Jul. 3, 2002

(86) PCT No.: PCT/JP02/06716

§ 371 (c)(1),
(2), (4) Date: Dec. 29, 2004

(87) PCT Pub. No.: WO2004/004496

PCT Pub. Date: Jan. 15, 2004

(65) Prior Publication Data

US 2005/0257311 A1 Nov. 24, 2005

(51) Int. Cl.
*A41B 11/00* (2006.01)
*A43B 17/00* (2006.01)
*D04B 9/56* (2006.01)

(52) U.S. Cl. ..... 2/239; 66/187

(58) Field of Classification Search ..... 2/239–242, 2/409, 161.7, 168, 163, 169; 66/178 R, 187, 66/185, 184, 186; 36/102, 114, 94, 10
See application file for complete search history.

(56) References Cited

U.S. PATENT DOCUMENTS 366,503 A * 7/1887 ONiell ..... 36/140
1,097,018 A * 5/1914 Hadfield ..... 2/168
1,308,483 A * 7/1919 Craighead ..... 2/239
1,368,255 A * 2/1921 Hall ..... 66/187
1,553,811 A * 9/1925 Gilbert ..... 2/241
1,741,340 A * 12/1929 Scholl ..... 2/239
1,798,201 A * 3/1931 Hedges ..... 2/239
2,422,736 A * 6/1947 Lambert ..... 2/241
RE24,314 E * 5/1957 Getaz ..... 66/187
2,821,847 A * 2/1958 Getaz ..... 66/185
2,932,829 A * 4/1960 Corbin ..... 2/239
3,013,564 A * 12/1961 Levey ..... 36/170
3,128,763 A * 4/1964 Langenfeld et al. ..... 128/894
3,173,278 A * 3/1965 Kaylor ..... 66/172 R
3,283,338 A * 11/1966 Landau ..... 2/161.6
3,457,739 A * 7/1969 Frand et al. ..... 66/202
3,548,614 A * 12/1970 Janda et al. ..... 66/95

(Continued)

FOREIGN PATENT DOCUMENTS

EP 10-331002 12/1998

(Continued)

*Primary Examiner*—Alissa L Hoey
(74) *Attorney, Agent, or Firm*—Paul F. Neils, Esq.; Akerman Senterfitt

(57) ABSTRACT

A sock that has a bulge portion (11) extending vertically of the toes that, in the intermediate portion of a toe portion (10) covering the toes, is disposed in the instep (10*b*) and/or sole (10*a*) of the foot, whereby when the toes are inserted in the toe portion (10), the bulge portion (11) allows the toe portion (10) to deform easily along the toes, thus making the insertion of the toes smooth at the time of wearing and, on completion of wearing, providing room around the toes by the bulge portion (11) so as to avoid a feeling of excessive tightening.

4 Claims, 11 Drawing Sheets

U.S. PATENT DOCUMENTS 3,721,111 A * 3/1973 Billi ..... 66/187
3,841,113 A * 10/1974 Lucke et al. ..... 66/95
3,867,727 A * 2/1975 Povlacs ..... 2/167
3,905,212 A * 9/1975 Bounous et al. ..... 66/185
4,277,959 A * 7/1981 Thorneburg ..... 66/182
4,341,097 A * 7/1982 Cassidy et al. ..... 66/187
4,441,213 A * 4/1984 Trumble et al. ..... 2/16
4,651,354 A * 3/1987 Petrey ..... 2/239
5,555,832 A 9/1996 Conti
5,560,226 A * 10/1996 Throneburg ..... 66/185
5,774,898 A * 7/1998 Malpee ..... 2/239
5,791,163 A * 8/1998 Throneburg ..... 66/178 R
5,802,877 A * 9/1998 Yates et al. ..... 66/21
5,906,007 A * 5/1999 Roberts ..... 2/239
6,000,247 A * 12/1999 Takeda et al. ..... 66/187
6,016,575 A * 1/2000 Prychak ..... 2/239
6,021,527 A * 2/2000 Lessard ..... 2/239
6,029,276 A * 2/2000 White ..... 2/161.6
6,138,281 A * 10/2000 Chiaruttini ..... 2/239
D444,940 S * 7/2001 Murrey ..... D2/989
6,415,443 B1 * 7/2002 Schierenbeck et al. ..... 2/159
D478,405 S * 8/2003 Hatcher et al. ..... D2/617
6,704,941 B1 * 3/2004 Palm ..... 2/239
6,708,348 B1 * 3/2004 Romay ..... 2/239
6,760,923 B1 * 7/2004 Tate ..... 2/159
6,935,141 B2 * 8/2005 Takeda et al. ..... 66/187
2004/0221371 A1 * 11/2004 Kato ..... 2/239
2005/0235702 A1 * 10/2005 Takeda et al. ..... 66/186

FOREIGN PATENT DOCUMENTS

EP 1518470 A1 * 3/2005
JP 51-76722 6/1976
JP S63-158902 1/1988
JP 0 636 729 A2 2/1995
JP 07-145503 6/1995
JP H11-021703 1/1999

* cited by examiner (a)

(b)

Prior Art

Prior Art

SOCKS

This application is a national stage of PCT/JP2002/006716 filed Jul. 3, 2002 under the International Convention.

BACKGROUND OF THE INVENTION

1. Field of the Invention

This invention relates to socks, and particularly to socks that have little feeling of construction when worn.

2. Description of the Related Art

Generally, a sock as shown by reference number 1 in FIG. 10 comprises: a tubular knit section 2 that has a foot-insert section 2*a* and that extends from near the ankle of the foot to the instep and arch of the foot; and a toe section 3 that is connected to the tubular-knit section 2 in a tapering shape and covers the toes, and where particularly, as shown in FIG. 11, this toe section 3 comprises a sole section 3*a* that covers the lower half of the toes, and a instep section 3*b* that covers the upper half of the toes, and the sole section 3*a* and instep section 3*b* are formed into a flat tubular shape and closed on the tip end by knitting them together into a flat shape.

In the case of this kind of conventional sock 1, when inserting the foot through the foot-insert section 2*a* and inserting the toes into the toe section 3, the toes must be inserted into the sole section 3*a* and instep section 3*b* of this toe section 3 while deforming them into a tubular shape.

Therefore, particularly, the wearer feels a tight fit around the toes in the tapered toe section 3, and after the sock is put on, feels constriction around the toes.

Taking this kind of problem into consideration, the object of this invention is to provide a sock that particularly loosens the fit in the tapered toe section, and reduces the feeling of constriction after the sock is put on.

SUMMARY OF THE INVENTION

The sock of this invention is a sock comprising a toe section that covers the toes, and a bulge section in the middle section of the toe section that bulges in the vertical direction of the toes.

With this kind of construction, when the toes are inserted into the toe section, this toe section deforms easily along the toes due to the bulge section.

As a result, when putting the sock on, the toes can be inserted smoothly, and after the sock is put on, there is space around the toes due to the bulge section, and thus it is possible to avoid a feeling of excessive constriction.

Here it is preferred that the bulge section becomes gradually thinner going from the side of the large toe toward the side of the small toe.

In the sock of this invention, the bulge section is formed in the section that covers the lower half or the upper half of the toes.

By using this kind of construction, it is possible to make the shape of the toe section after the sock has been put on close to the shape of the toes, and thus it is possible to further improve the fit and feeling of constriction.

Moreover, it is also possible to form the bulge section where it will cover the lower half of the toes and the upper half of the toes, and this makes it possible to improve the fit and feeling of constriction even more.

Also, in the sock of this invention, the toe section is divided into a first insert section where the large toe is inserted, and a second insert section where the other toes are inserted, and bulge sections are formed in both the first insert section and second insert section.

With this kind of construction, it is possible to maintain the function of improving the fit and feeling of constriction described above, and since the toe section is located between the large toe and other toes, shifting of the toe section and toes is suppressed, and thus it is possible to improve the fit.

Furthermore, the sock of this invention is formed by dividing the toe section into five insert sections into which the toes are individually inserted, and forming bulge sections in each of these five insert sections.

With this kind of construction, it is possible to maintain the function of improving the fit and feeling of constriction described above, as well as further improving the function of suppressing shifting of the toes in the toe sections, and thus it is possible to improve the fit even more.

DESCRIPTION OF THE DRAWINGS

In order to explain the invention in more detail, it will be explained with reference to the accompanying drawings.

First Embodiment

Figure 1:
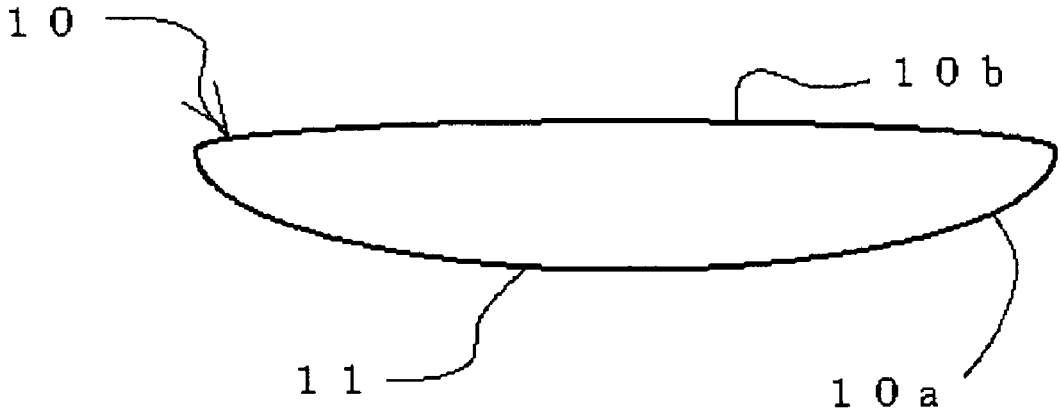
FIG. 1 is a vertical cross-sectional view showing the toe section of a first embodiment of the invention.
Figure 2:
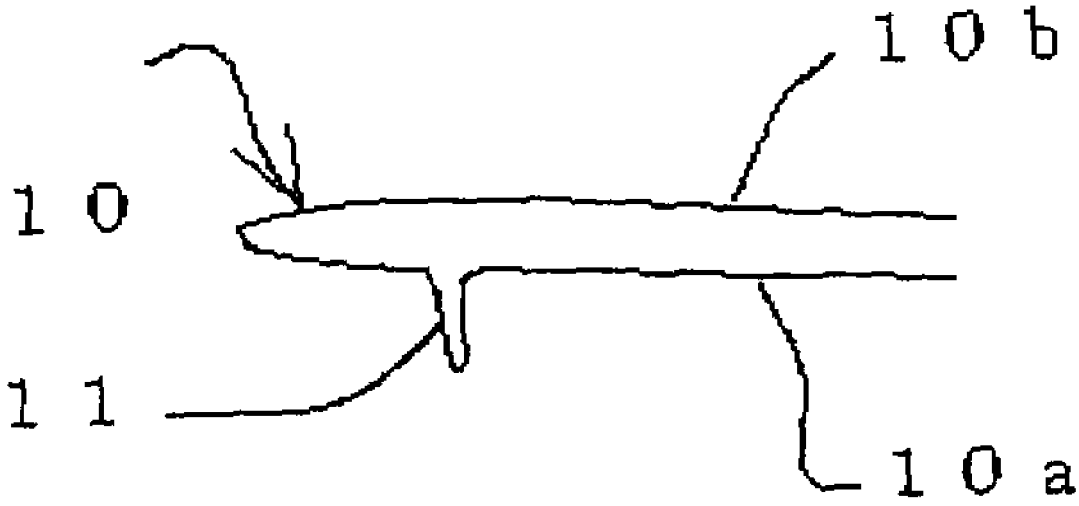
FIG. 2 is a side view of the toe section of a first embodiment of the invention.
Figure 3:
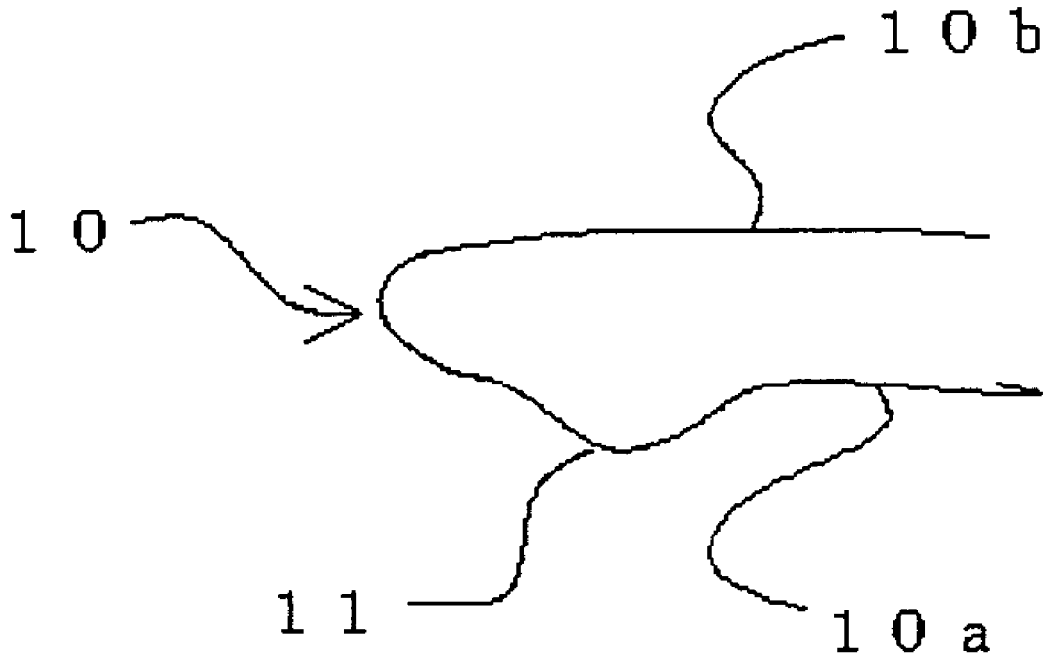
FIG. 3 shows the toe section of a first embodiment of the invention, and is a side view showing the state of deformation when the sock is worn.
Figure 10:
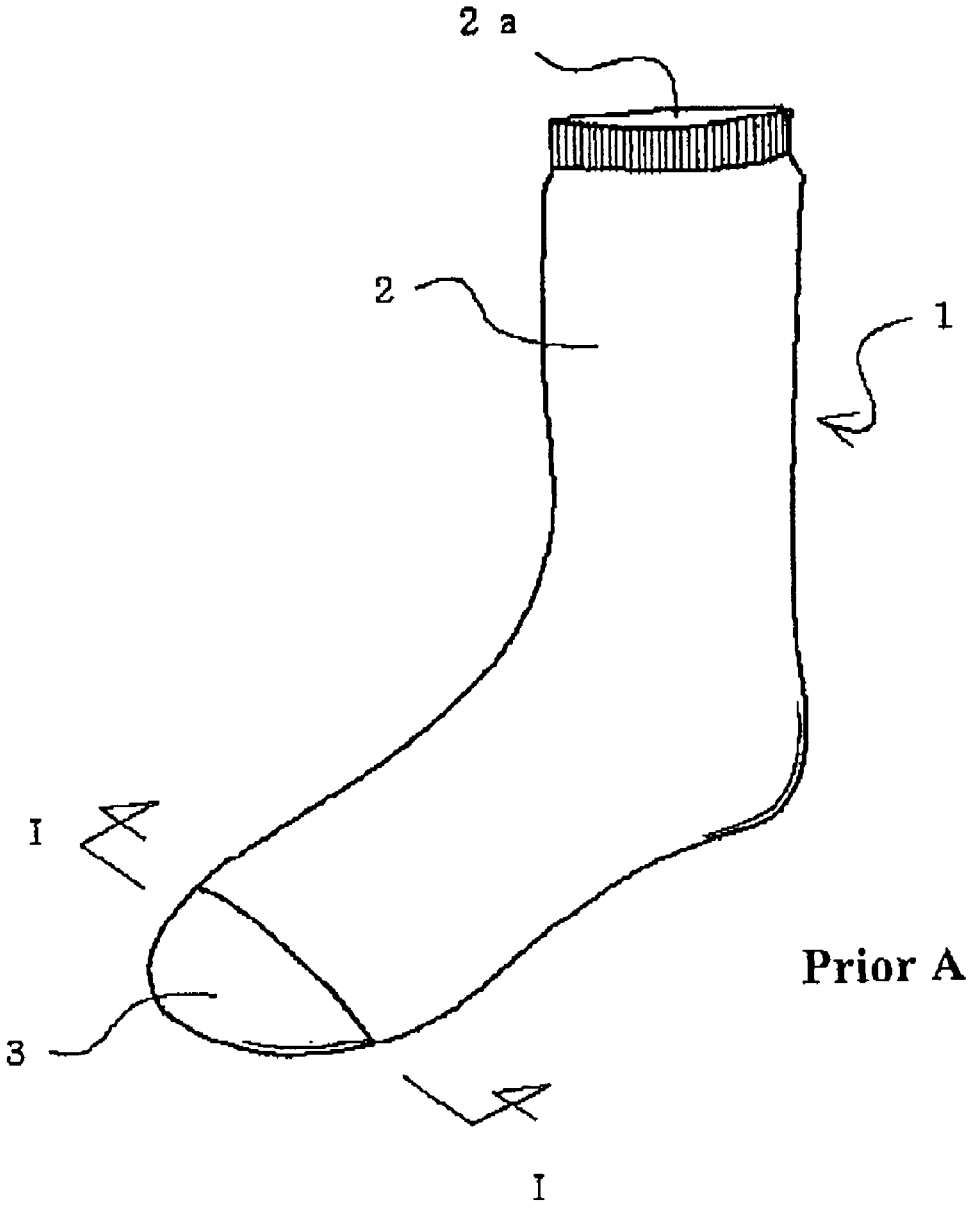
FIG. 10 is an external pictorial view of a typical sock.
Figure 11:
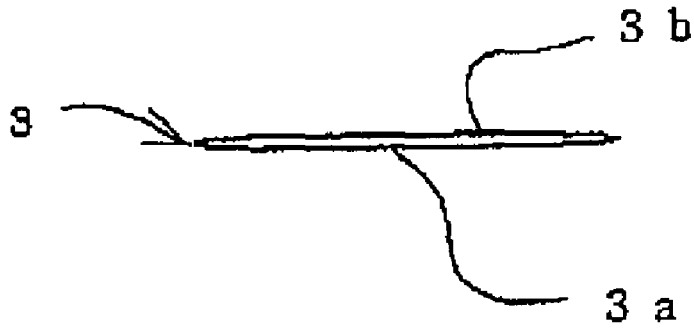
FIG. 11 is a sectional view along the line 1-1 of FIG. 10.

FIG. 1 to FIG. 3 show the toe section 10 of the sock of a first embodiment of the invention, where FIG. 1 is a vertical cross-sectional view of the toe section 10, FIG. 2 is a side view of the toe section 10 and FIG. 3 is a side view when the sock is worn; and the other parts are common with those shown in FIG. 10 so they will be explained using FIG. 10 and the reference numbers used in FIG. 10.

This embodiment is characterized by forming a bulge section 11 in the middle part of the toe section 10 that is formed such that it continuous with the end section of the tubular knitted section 2.

The toe section 10 is knitted completely into a flat tubular shape and comprises a sole section 10*a* that covers the bottom part of the toes and the instep section 10*b* that covers the top part of the toes.

Moreover, in this embodiment, the bulge section 11 is formed in the middle part in the lengthwise direction of the toes in the sole section 10*a*, and when knitting this sole section 10*a*, and with the knitting location held fixed, the knitting needles are gradually decreased, after which they are gradually increased.

Furthermore, the bulge section 11 is formed such that it is a simple arc shape that protrudes downward.

In the case of the sock of this embodiment that is constructed in this way, when putting on the sock and the toes are inserted into the toe section 10, the toe section 10 is stretched and deformed in the front and back direction as well as the up and down direction.

Also, as shown in FIG. 3, by forming a bulge section 11 in the sole section 10*a*, the sole section 10*a* deforms in correspondence to the inserted toes.

Therefore, when inserting the toes into the toe section 10, the resistance to the insertion is reduced, and a good fit is obtained, and since there is little stretching in the bulge section 11 after being put on, the constrictive force applied to the toes is reduced, and as a result, the feeling of constriction is reduced and a comfortable fit is obtained.

Figure 4:
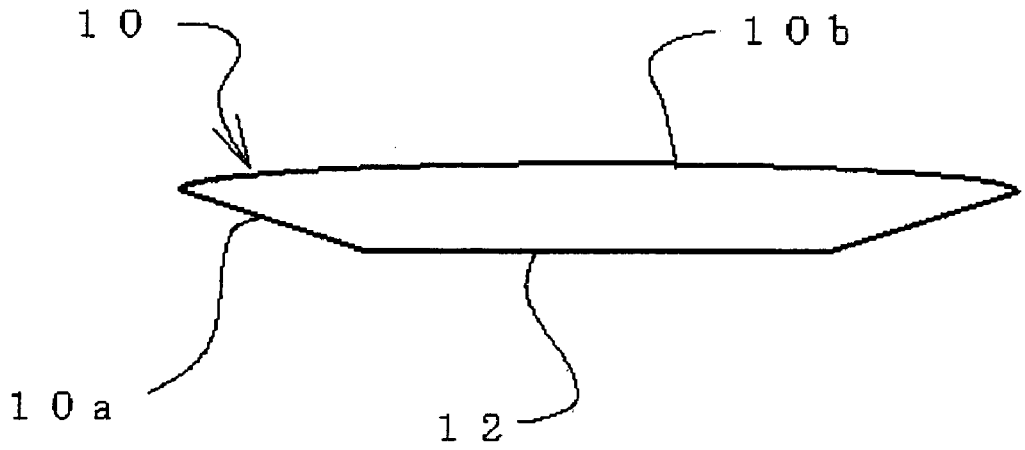
FIG. 4 is vertical cross-sectional view of other examples of the toe section of this invention.
Figure 4:
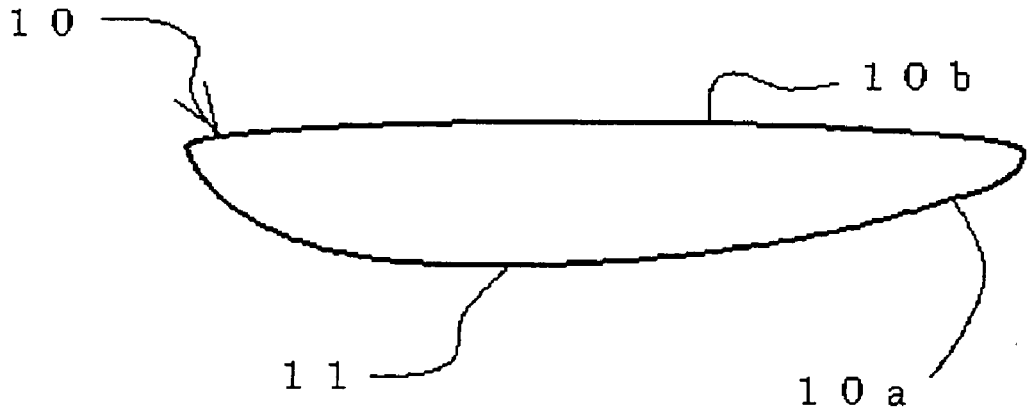

On the other hand, an example of forming the bulge section 11 into a simple arc shape was described, however, instead of this, it is also possible for the bulge section to be a trapezoidal shape as shown in FIG. 4A.

Also, as shown in FIG. 4B, it is also possible to form the bulge section 11 such that it gradually becomes thinner in the direction from the large toe to the small toe, and with this kind of construction, the bulge section corresponds to the shape of the toes and improves the fit and feeling of constriction even more.

Figure 5:
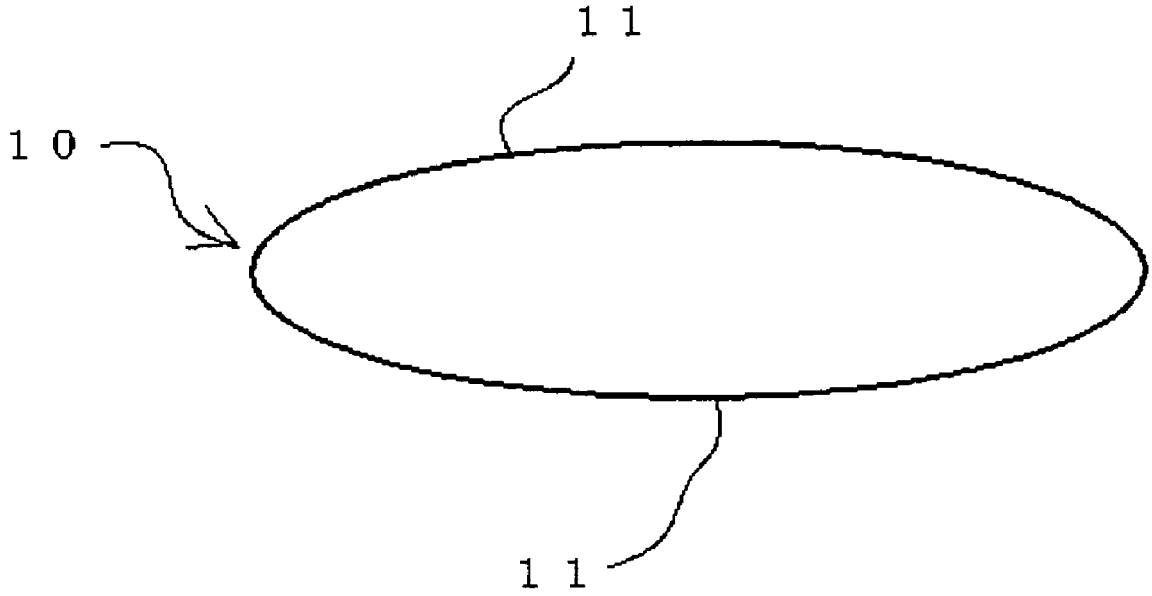
FIG. 5 is a vertical cross-sectional view of yet another example of the toe section of this invention.
Figure 6:
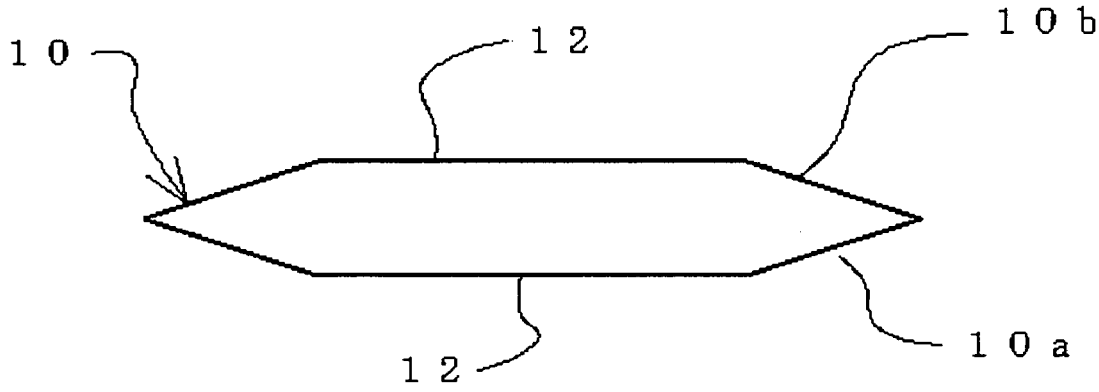
FIG. 6 is a vertical cross-sectional view of even yet another example of the toe section of this invention.

Moreover, these bulge sections 11, 12 can be formed in not only the sole section 10*a*, but as shown in FIG. 5 and FIG. 6, can also be formed in the instep section 10*b*, or furthermore, could be formed in just this instep section 10*b*.

Figure 7:
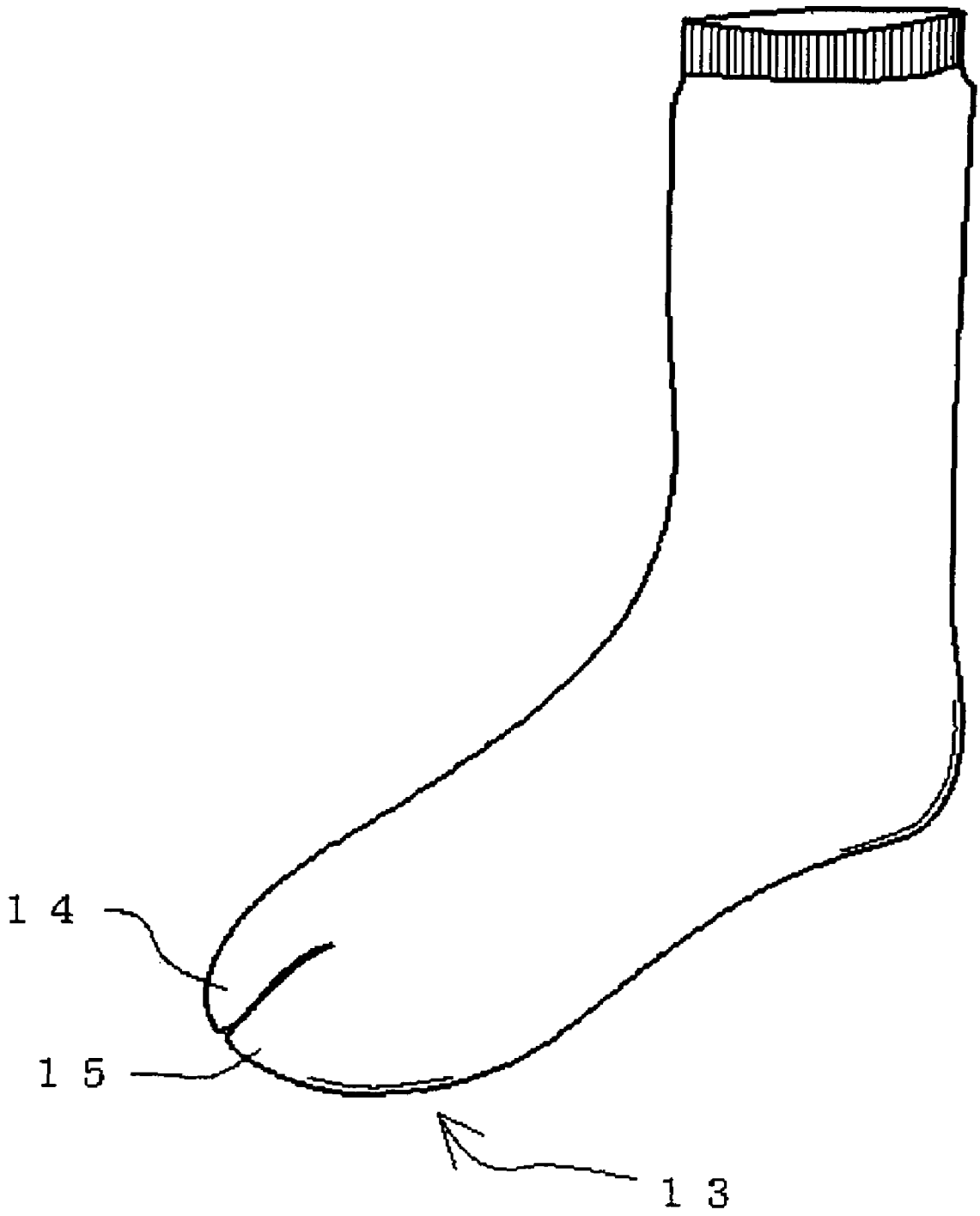
FIG. 7 is an external pictorial view of another example of this invention.
Figure 8:
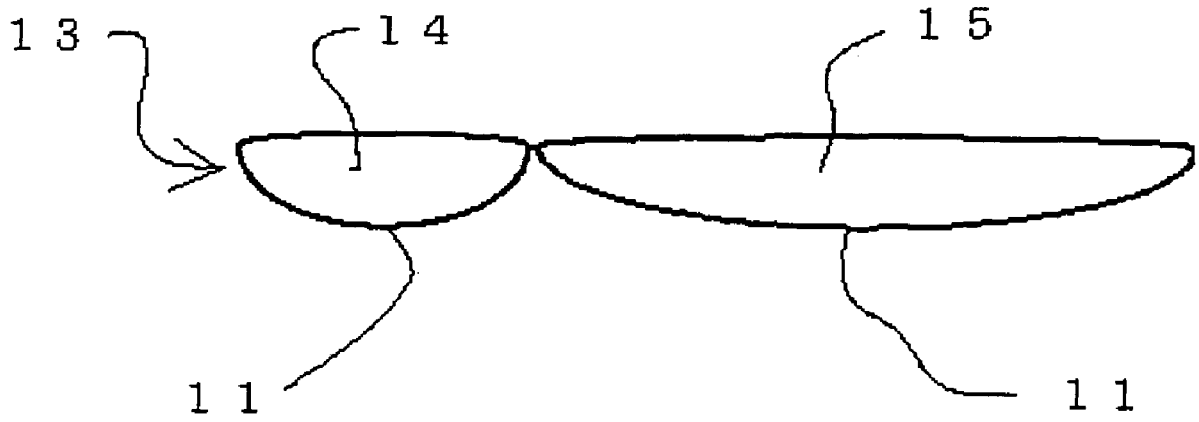
FIG. 8 is a vertical cross-sectional view of the toe section of FIG. 7.

Also, as in the toe section indicated by reference number 13 in FIG. 7, this toe section 13 can be formed such that it is divided into a first insert section 14 into which the large toe is inserted, and a second insert section 15 into which the other toes are inserted, and as shown in FIG. 8, a bulge section 11 can be formed into both the first insert section 14 and second insert section 15.

By forming a first insert section 14 and second insert section 15 in the toe section 13 like this, and by holding the toe section between the large toe and the adjacent toe, it is possible to suppress shifting of the toes in the toe section 13 and to improve the fit.

Figure 9A:
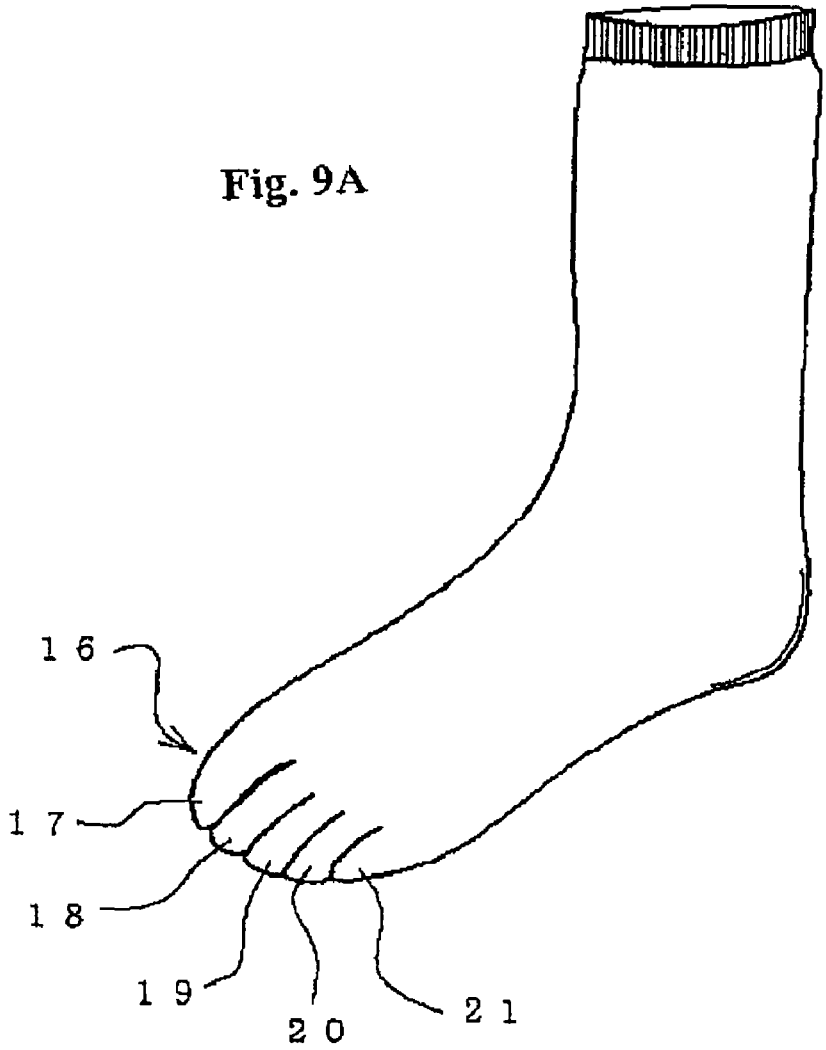
FIG. 9A is an external pictorial view of another example of the invention.
Figure 9B:
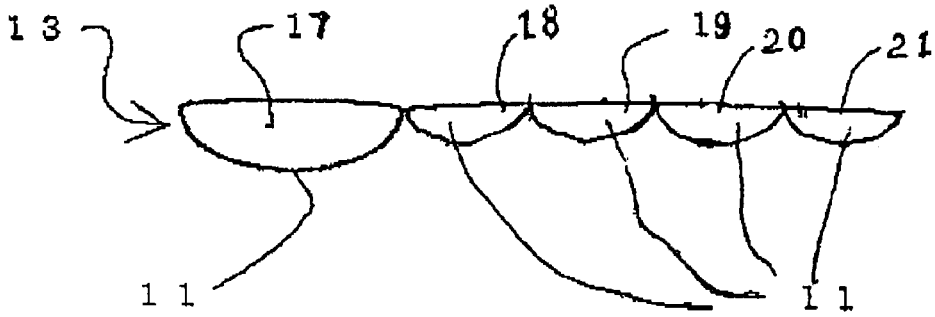
FIG. 9B is a vertical cross-sectional view of the toe section of FIG. 9A.

Also, as in the toe section indicated by the reference number 16 in FIG. 9, this toe section 16 is formed such that it is divided in first to fifth insert sections 17 to 21 that correspond to each of the toes; and even though not shown in the drawings, it is also possible to form a bulge section in each of the insert sections 17 to 21.

With this kind of construction, while maintaining the fit described above, each toe is independently covered so it is possible to eliminate sweating and the like, and make wearing the sock more comfortable.

Also, in the case where insert sections 17 to 21 that correspond to the toes are formed, resistance to the insertion of the toes is increased, however, in this invention, since bulge sections are formed in each of the insert sections to 17 to 21, the aforementioned insert resistance is reduced, the sock can be put on smoothly.

Furthermore, the insert section described above could also be an insert section for an arbitrary number of toes that covers from the index toe (second toe) to the next to the last toe (fourth toe).

Also, the tubular knit section 2 described above could be changed among various shapes such as a shape that covers the calf, a shape that covers the ankle, or a shape that covers to just below the ankle.

INDUSTRIAL APPLICABILITY

As described above, with this invention, by forming a bulge section that runs along the vertical direction of the toes in the middle section of the toe section that covers the toes, when inserting the toes, this toe section deforms easily along the toes, and as a result, the toes can be inserted smoothly when putting the sock on, and after the sock has been put on, the bulge section forms space around the toes, so it is possible to avoid a feeling of excessive constriction.

DESCRIPTION OF REFERENCE NUMBERS

1. sock
2. tubular knitted section
2*a*. Foot-insert section
3. toe section
3*a*. sole section
3*b*. instep section
10. toe section
10*a*. sole section
10*b*. instep section
11. bulge section
12. bulge section
13. toe section
14. first insert section
15. second insert section
16. toe section
17. first insert section
18. second insert section
19. third insert section
20. fourth insert section
21. fifth insert section

What is claimed is:

1. A sock, comprising:

a tubular section which has a foot-insert section;

a toe section for covering toes and which is connected to the tubular section, said toe section being knitted into a flat tubular shape, said toe section including a sole section covering a bottom part of the toes and an instep section covering a top part of the toes, said sole section having a first end at a tip of the toes and a second end at the root of the toes; and a bulge section formed in a middle part of said sole section between said first end and said second end of said toe section, wherein when forming the bulge section, with the knitting location being held fixed, the knitting needles are gradually decreased, and thereafter, they are gradually increased;

wherein said bulge section is formed such that it has an arc shape that protrudes vertically downward when the sock is not worn; and wherein the sock is a fully completed article which is devoid of any openings other than said foot-insert section.

2. The sock of claim 1, wherein said bulge section is formed such that it gradually becomes thinner from a side of a large toe toward a side of a little toe.

3. The sock of claim 1, wherein said toe section is formed such that it is divided into a first insert section into which a large toe is inserted, and a second insert section into which other toes are inserted, and bulge sections are formed in both the first insert section and second insert section.

4. The sock of claim 1, wherein said toe section is formed such that it is divided into five insert sections for each of the individual toes, and bulge sections are formed for each of the five insert sections.

* * * * *